US005092485A

United States Patent [19]

Lee

[11] Patent Number: 5,092,485

[45] Date of Patent: Mar. 3, 1992

[54] THERMOS PAPER CUP

[75] Inventor: T. T. Lee, Taipei, Taiwan

[73] Assignee: King Car Food Industrial Co., Ltd., Taipei, Taiwan

[21] Appl. No.: 666,705

[22] Filed: Mar. 8, 1991

[51] Int. Cl.[5] ..... B65D 21/00

[52] U.S. Cl. ..... 220/441; 229/1.5 B

[58] Field of Search ..... 229/1.5 B; 220/441, 220/464, 468, 469

[56] References Cited

U.S. PATENT DOCUMENTS

| | | | |
|---|---|---|---|
| 1,771,765 | 7/1930 | Benson | 229/1.5 B |
| 2,266,828 | 12/1941 | Sykes | 229/1.5 B X |
| 2,591,578 | 4/1952 | McNealy et al. | 229/1.5 B |
| 2,617,549 | 11/1952 | Egger | 229/1.5 B |
| 2,661,889 | 12/1953 | Phinney | 229/1.5 B |
| 2,853,222 | 9/1958 | Gallagher | 229/1.5 B |
| 3,141,913 | 7/1964 | Edwards | 229/1.5 B |
| 3,237,834 | 3/1966 | Davis et al. | 229/1.5 B |
| 3,456,860 | 7/1969 | Janninck | 229/1.5 B |
| 3,908,523 | 9/1975 | Shikaya | 229/1.5 B X |

*Primary Examiner*—Steven M. Pollard

*Attorney, Agent, or Firm*—Morton J. Rosenberg; David I. Klein

[57] ABSTRACT

This invention relates to a thermos paper cup and in particular to one provided with a plurality of air chambers between the inner side and the outer side and having a distance between the bottom and the lower edge so as to separate the contents from the outside thereby keeping the contents at an unchanged temperature.

1 Claim, 3 Drawing Sheets

THERMOS PAPER CUP

BACKGROUND OF THE INVENTION

It is found that the paper cup on the market is simply made of a paper board wrapped into a hollow cylindrical member and a circular bottom engaged with the hollow cylindrical member. However, such paper cup can only be used for receiving tea, coffee, etc. but cannot be used to keep the temperature of the contents.

Therefore, it is an object of the present invention to provide an improved paper cup which may obviate and mitigate the above-mentioned drawbacks.

SUMMARY OF THE INVENTION

This invention relates to the improved structure of a thermos paper cup.

It is the primary object of the present invention to provide a thermos paper cup which is composed of an inner cup, an intermediate cup and an outer cup.

It is another object of the present invention to provide a thermos paper cup which has air chambers between the inner and outer cups thereby decreasing the coefficient of conductivity.

It is still another object of the present invention to provide a thermos paper cup which is simple in construction and effective in keeping the contents at an unchanging temperature.

It is a further object of the present invention to provide a thermos paper cup which is fit for mass production and economic to produce.

Other objects and merits and a fuller understanding of the present invention will be obtained by those having ordinary skill in the art when the following detailed description of the preferred embodiment will be obtained by those having ordinary skill when the following detailed description is read in conjunction with the accompanying drawings.

DETAILED DESCRIPTION OF THE PREFERRED EMBODIMENT

Figure 1:
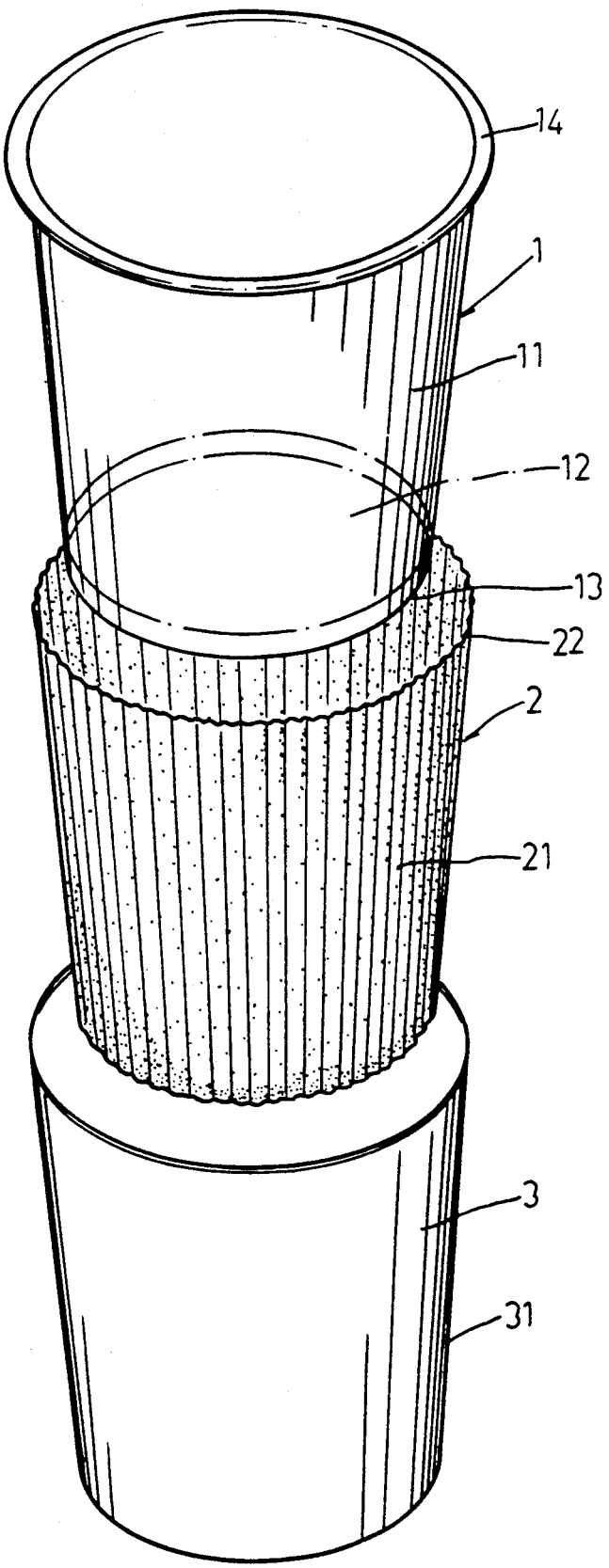
FIG. 1 is an exploded view of a thermos paper cup according to the present invention.
Figure 3:
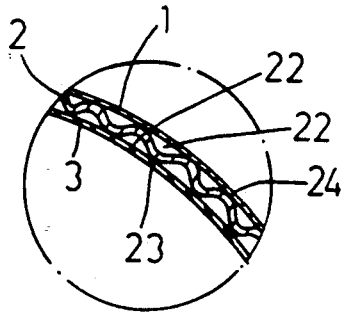
FIG. 3 is an enlarged fragmentary view of the thermos paper cup.
Figure 2:
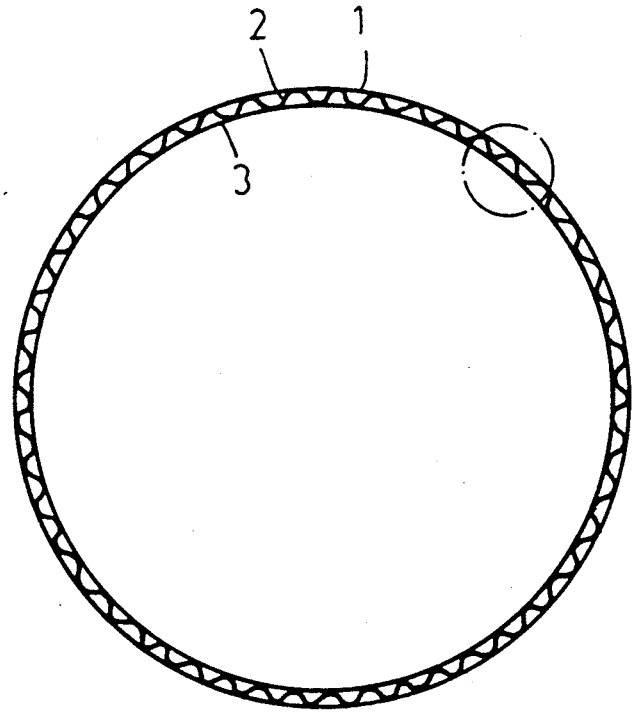
FIG. 2 is a cross sectional view of the thermos paper cup.
Figure 4:
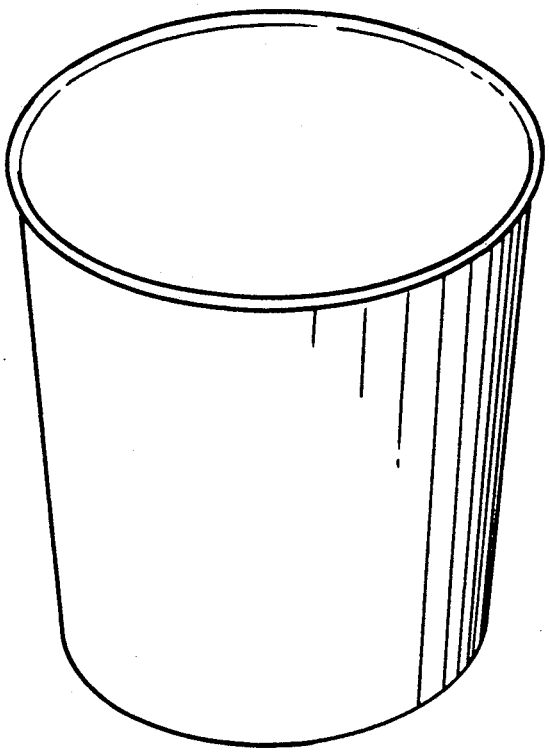
PRIOR ART FIG. 4
FIG. 4 is a perspective view of a prior art paper cup.
Figure 5:
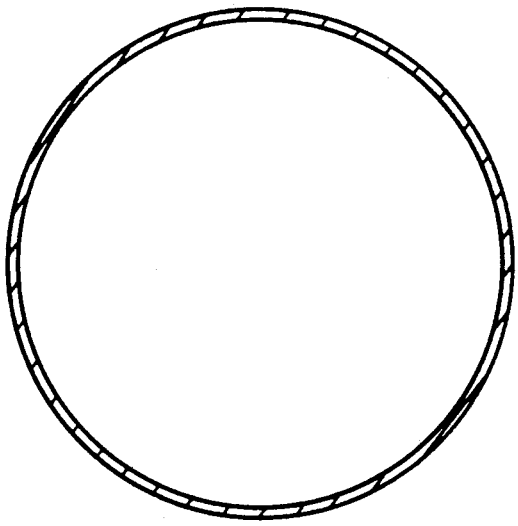
PRIOR ART FIG. 5
FIG. 5 is a cross sectional view of the prior art paper cup.

With reference to the drawings and in particular to FIG. 1 thereof, the thermos paper cup according to the present invention mainly comprises an inner cup 1, an intermediate cup 2 and an outer cup 3.

The inner cup 1 is made of a paper board wrapped into a hollow cylindrical member 11 and a circular bottom 12 engaged with an end of the hollow cylindrical member 11 and having a distance from the lowermost edge 13 of the end of the hollow cylindrical member 11. Hence, the lowermost edge 13 acts as the foot for the inner cup 1. Further, the uppermost edge of the cylindrical member 11 is provided with an enlarged rim 14 so as to strengthen the structure of the inner cup 1.

The intermediate cup 2 is made of a piece of corrugated paper wrapped to form a hollow cylindrical member 21 with a plurality of longitudinal grooves 22 and may just receive the inner cup 1 so that when the inner cup 1 is fitted into the intermediate cup 2, the surface of the intermediate cup 2 is provided with a plurality of a shape of continuous sine-waves. Hence, the inner cup 1 is actually in contact with the troughs 23 of the intermediate cup 2 thereby forming a plurality of longitudinal air chambers between the inner cup 1 and the intermediate cup 2.

The outer cup 3 is also made of a paper board wrapped into a hollow cylindrical member 31 which may just receive the intermediate cup 2 and is fixedly connected thereto. As the surface of the intermediate cup 2 has a shape of continuous sine-waves, the outer cup 3 is actually in contact with the crest 24 of the intermediate cup 2 thereby forming a plurality of longitudinal air chambers between the intermediate cup 2 and the outer cup 3.

When the thermos cup according to the present invention is filled with a drink, the upper surface of the drink will be in contact with the air (the thermos cup may be covered with a lid) and the lower surface of the drink will be directly in contact with the circular bottom 12. Since there is a distance between circular bottom 12 and the foot of the inner cup 1, the heat of the lower surface of the drink can dissipate only through the foot of the inner cup 1 and the space between the foot and the circular bottom 12. However, as the foot is only made of a circular rim, the contact area between the foot and the outside is very small and the space between the foot and the table top is closed thus achieving the purpose of keeping the contents at an unchanging temperature. Regarding the lateral side of the drink, it is directly in contact with the inner surface of the inner cup 1. Nevertheless, there are a plurality of longitudinal air chambers between the outer side of the inner cup 1 and the inner side of the intermediate cup 2 and between the outer side of the intermediate cup 2 and the inner side of the outer cup 3 so that the heat evolved from the lateral side of the contents in the present invention dissipates through two layers of air chambers while the heat evolved from the bottom of the contents dissipates via the foot with small area and the contents may be kept at an unchanged temperature.

Although the present invention has been described with a certain degree of particularity, it is understood that the present disclosure is made by the way of example only and that numerous changes in the detail of construction and the combination and arrangement of parts may be resorted to without departing from the spirit and scope of the invention as hereinafter claimed.

I claim:

1. A thermos paper cup comprising:

an inner cup made of a paper board wrapped into a hollow cylindrical member and a circular bottom engaged with an end of the hollow cylindrical member said circular bottom being vertically displaced from a lowermost edge of the end of the hollow cylindrical member, said cylindrical member having an enlarged outwardly turned rim at an uppermost edge so as to strengthen the structure of said inner cup;

an intermediate cup formed of a piece of corrugated paper wrapped to form a hollow cylindrical member and a circular bottom engaged with an end of the hollow cylindrical member, said hollow cylindrical member having a plurality of longitudinal grooves for receiving said inner cup so that when said inner cup is inserted into the intermediate cup, the intermediate cup cross-sectional contour defines a contour of continuous sinewaves thereby forming a plurality of longitudinal air chambers between said inner cup and said intermediate cup; and an outer cup made of a paper board wrapped into a hollow cylindrical member and a circular bottom engaged with an end of the hollow cylindrical member which receives said intermediate cup so that said outer cup is interfaced with a contour of said continuous sine-waves thereby forming a plurality of longitudinal air chambers between said intermediate cup and said outer cup.

* * * * *